US007883088B2

(12) United States Patent
Nützel et al.

(10) Patent No.: US 7,883,088 B2
(45) Date of Patent: Feb. 8, 2011

(54) APPARATUS FOR SINGLING OF SHEET MATERIAL

(75) Inventors: Dominik Nützel, Munich (DE); Franz Reuter, Dorfen (DE); Xavier Thum, Wolfratshausen (DE)

(73) Assignee: Giesecke & Devrient GmbH, Munich (DE)

( * ) Notice: Subject to any disclaimer, the term of this patent is extended or adjusted under 35 U.S.C. 154(b) by 99 days.

(21) Appl. No.: 12/363,218

(22) Filed: Jan. 30, 2009

(65) Prior Publication Data

US 2009/0206541 A1 Aug. 20, 2009

Related U.S. Application Data

(60) Provisional application No. 61/091,898, filed on Aug. 26, 2008.

(30) Foreign Application Priority Data

Jan. 30, 2008 (DE) ..... 10 2008 006 743

(51) Int. Cl.
*B65H 7/02* (2006.01)

(52) U.S. Cl. ..... 271/258.01; 271/259; 271/265.01

(58) Field of Classification Search ..... 271/258.01, 271/259, 265.01; 235/375–382, 382.5, 383–386; 73/800

See application file for complete search history.

(56) References Cited

U.S. PATENT DOCUMENTS 5,344,134 A 9/1994 Saeki et al.

(Continued)

FOREIGN PATENT DOCUMENTS

DE 10 2005 008 747 A1 8/2006

(Continued)

OTHER PUBLICATIONS

Search Report of German Patent Office in German Patent Application No. 10 2008 006 743.1 (Dec. 2008).

*Primary Examiner*—Stefanos Karmis
*Assistant Examiner*—Prasad V Gokhale
(74) *Attorney, Agent, or Firm*—Bacon & Thomas, PLLC

(57) ABSTRACT

Apparatus for singling sheet material, in particular bank notes, which is inputted into an input area of the apparatus as a stack and is transported up to a singler, which transfers individual pieces of sheet material of the stack of sheet material to a sheet transport system, which transports the singled sheet material in a transport direction, a sensor disposed in transport direction upstream of the singler, which substantially extends over the width of the input area, generating signals which specify whether and in which area of the width of the input area the sheet material is present, and a control device evaluating the signals of the sensor during a transport of the stack of sheet material to the singler and comparing occurring fluctuations and changes of the signals of the sensor regarding the presence or absence of sheet material with predetermined threshold values for fluctuations and changes of the signals of the sensor, in order to derive a statement from the occurring fluctuations and changes of the signals of the sensor, whether the pieces of sheet material forming the stack of sheet material are aligned to each other with respect to their edges, and whether the stack of sheet material has an alignment which substantially is in parallel to the transport direction of the transport system.

6 Claims, 1 Drawing Sheet

U.S. PATENT DOCUMENTS 5,662,321 A * 9/1997 Borostyan et al. ..... 271/10.03
7,107,903 B2 * 9/2006 Tokinaga et al. ..... 101/232
7,255,338 B2 * 8/2007 Wilfer et al. ..... 271/10.03
2003/0132572 A1 * 7/2003 Rompe ..... 271/258.01
2003/0141653 A1 * 7/2003 Kumamoto et al. ..... 271/262

FOREIGN PATENT DOCUMENTS

WO WO 2006/064008 A1 6/2006

* cited by examiner

APPARATUS FOR SINGLING OF SHEET MATERIAL

BACKGROUND OF THE INVENTION

A. Field

The present invention relates to an apparatus for singling sheet material, in particular bank notes, which is inputted into the apparatus as a stack.

B. Related Art

Known machines for accepting sheet material, in particular bank notes or other documents of value, have an apparatus for singling sheet material. The sheet material to be singled is inputted into the apparatus for the singling as a loose stack consisting of a plurality of pieces or sheets of sheet material. Here it can be provided, that the sheet material is inputted into the apparatus for the singling by an operator in such a way, that the individual pieces of sheet material are grasped one after the other by the apparatus and are separately transferred to a sheet transport system for further processing. Likewise, it is possible, that the operator inputs the sheet material only partially into the apparatus for singling sheet material. In this case the stack of sheet material is completely transported into the apparatus for the singling by a stack transport system. Subsequently, the individual pieces of sheet material, as described above, can be grasped by the apparatus for the singling and separately transferred to the sheet transport system.

When the sheet material is singled, however, there often occur problems, because the stack is formed by individual pieces of sheet material, the edges of which are poorly aligned to each other, i.e. the edges of the individual pieces of sheet material do not extend in parallel to each other. In this case when being singled the individual pieces of sheet material are irregularly grasped by the apparatus for the singling, because of which the sheet material is not transported substantially in parallel to two of the outer edges of the sheet material by the subsequent sheet transport system. This oblique transport of the sheet material can lead to problems during the further processing, for example jams. Problems of the same kind will occur in the case, when the pieces of sheet material forming the stack are well aligned to each other with respect to their edges, but the whole stack of sheet material is obliquely inputted into the apparatus for the singling.

It is the object of the present invention to provide an apparatus for singling sheet material, in particular bank notes, which is inputted into the apparatus as a stack, with which the above described problems can be recognized and prevented.

SUMMARY OF THE INVENTION

The invention starts out from an apparatus for singling sheet material, in particular bank notes, which is inputted into an input area of the apparatus as a stack and is transported up to a singler which transfers individual pieces of sheet material of the stack of sheet material to a sheet transport system, which transports the singled sheet material in a transport direction, a sensor disposed in transport direction upstream of the singler, which substantially extends over the width of the input area, generating signals which specify whether and in which area of the width of the input area the sheet material is present, and a control device evaluating the signals of the sensor during a transport of the stack of sheet material to the singler and comparing occurring fluctuations and changes of the signals of the sensor regarding the presence or absence of sheet material with predetermined threshold values for fluctuations and changes of the signals of the sensor, in order to derive information from the occurring fluctuations and changes of the signals of the sensor, as to whether the pieces of sheet material forming the stack of sheet material are aligned with each other with respect to their edges, and whether the stack of sheet material has an alignment which substantially is in parallel to the sheet transport direction of the sheet transport system.

The advantage of the invention in particular is that the apparatus for the singling of sheet material, that is inputted into the input area of the apparatus as a stack, can recognize with the help of the evaluation of the signals of the sensor by the control device, whether an inputted stack of sheet material has a good stack quality, i.e. whether the sheet material forming the stack is well aligned to each other with respect to its edges, and whether the stack of sheet material altogether has been straightly inputted into the input area, i.e. whether the stack of sheet material altogether has a good alignment, i.e. in particular an alignment of its edges in parallel to the sheet transport direction.

In a development it is provided, that the control device controls the singler and prevents the singling of the stack of sheet material, when the check of the signals of the sensor yields that the pieces of sheet material forming the stack of sheet material are poorly aligned to each other with respect to their edges or the stack of sheet material has an alignment which deviates from the transport direction of the sheet transport system.

The development has the advantage that by preventing the singling of sheet material of stacks of sheet material which has a poor alignment, this can be the alignment of the sheet material to each other or the alignment of the entire stack to the transport direction of the transport system, malfunctions with the further processing of the singled sheet material can be prevented.

DESCRIPTION OF THE DRAWINGS

Further advantages of the present invention appear from the dependent claims and the following description of embodiments with reference to Figures.

DETAILED DESCRIPTION OF PREFERRED EMBODIMENTS OF THE INVENTION

Figure 1:
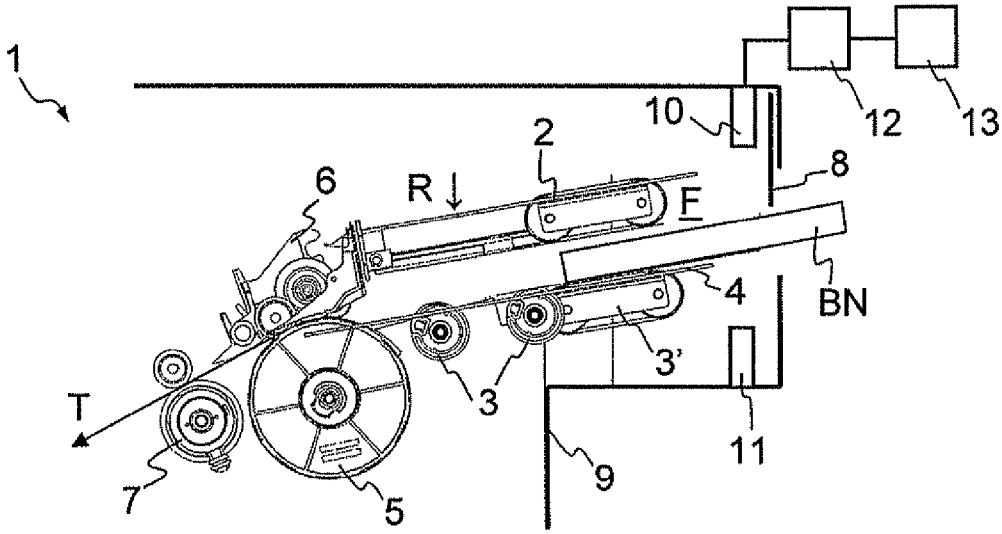
FIG. 1 shows a basic embodiment of an apparatus for singling sheet material, in particular bank notes, which is inputted into the apparatus as a stack.

In FIG. 1 is shown a basic embodiment of an apparatus 1 for singling sheet material BN, in particular bank notes, which is inputted into apparatus 1 as a stack.

Apparatus 1 is disposed in a housing 9 and has an input area F for the input of bank notes BN, which can be closed by a faceplate 8. The stack of bank notes BN is put onto a deposit surface 4 disposed in the input area F by an operator.

In input area F is located a sensor 10, 11, which extends over (i.e., senses) the width of input area F. Sensor 10, 11 for example can be formed by a light barrier, which has a row of light sources located side-by-side, e.g. light emitting diodes 11, opposite thereto being disposed a row of detectors located side-by-side, e.g. photodiodes 10, which receive the signals of the light emitting diodes. Instead of a linear light barrier sensor 10, 11 can also be formed by a line camera. The line camera, for example, can have the form of a CCD sensor 10, opposite of which is disposed a linear light source 11. Linear CCD sensor 10 itself, however, can also be provided with a linear light source, the reflected light of which CCD sensor 10 receives. It is also possible, that CCD sensor 10 detects reflected ambient light, i.e. is not provided with a light source.

When sensor 10, 11 recognizes the input of bank notes BN, a first part 2 of a stack transport system 2, 3, 3' is moved in a direction R towards bank notes BN until bank notes BN are clamped between the first part 2 of stack transport system 2, 3, 3' and the deposit surface 4. In deposit surface 4 is disposed a second part 3, 3' of the stack transport system 2, 3, 3'. After their clamping the bank notes BN clamped between first part 2 and second part 3, 3' of stack transport system 2, 3, 3', are transported by stack transport system 2, 3, 3', which can consist of belts 2, 3' and rolls 3, to a singler 5, 6. For this purpose it can be provided, that first 2 and second 3, 3' part of stack transport system 2, 3, 3' are driven. It is also possible, that only second part 3, 3' is driven. Likewise, it is possible, that only first part 2 is driven.

Singler 5, 6, for example, consists of a singling roller 5, which only grasps the most bottom bank note of the stack of bank notes BN at a time, a retaining device 6 holding back the other bank notes of the stack of bank notes BN. The one bank note grasped and singled by singler 5, 6 is transferred to a sheet transport system 7, which feeds the individual bank notes to a further processing, e.g. a check of the bank notes as to their type and authenticity. During the singling first part 2 of stack transport system 2, 3, 3' is not driven. The second part 3, 3' or a portion 3 of the second part 3, 3' of stack transport system 2, 3, 3', however, can be driven, so that only the most bottom bank note of the stack of bank notes BN at a time is transported to singler 5, 6.

Figure 2:
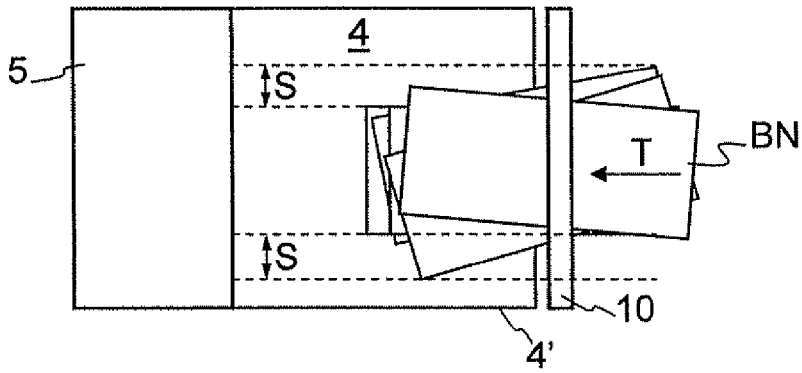
FIG. 2 shows the input of a first stack of sheet material into the apparatus for singling sheet material shown in FIG. 1.

FIG. 2 shows the input of a first stack of bank notes BN into apparatus 1 shown in FIG. 1. In FIG. 2 are shown deposit surface 4 of input area F, singling roller 5, and sensor 10.

The shown first stack of bank notes BN consists of a plurality of bank notes, which are poorly aligned to each other with respect to their edges. Such off-straight lying bank notes are irregularly grasped by singling roller 5, because of which then they are transported obliquely in different angles by sheet transport system 7 and can cause the problems described above when processed.

The problems on processing the bank notes BN can be prevented, when such a stack of bank notes BN is recognized and not singled. An evaluation of the signals of linear sensor 10, 11 with the help of a control device 12, which for example can be formed by a microprocessor, yields a strong fluctuation of the signals during the transport of the stack of bank notes BN to singler 5, 6, because the individual bank notes of the stack of bank notes BN, as shown, move within the dashed lines. During the transport of the stack of bank notes BN to singler 5, 6 in the areas of the linear sensor 10, 11 marked with the reference sign S there alternate the signals which indicate a presence or absence of bank notes. If the fluctuations of the signals of sensor 10, 11 between presence and absence of bank notes occur with a frequency, which is greater than a predetermined threshold value, a singling of the bank notes BN forming the stack will not be effected. In this case the stack of bank notes is transported out of input area F by transport system 2, 3, 3'. Control device 12 can generate an instruction for the operator and display it on a display device 13 of apparatus 1. In the described case of the frequent fluctuation of the signals of sensor 10, 11, which indicates a stack of bank notes BN poorly aligned to each other, the operator can be prompted to remove the stack of bank notes BN, to align bank notes BN to each other, and to re-input the stack of bank notes BN into input area F.

Figure 3:
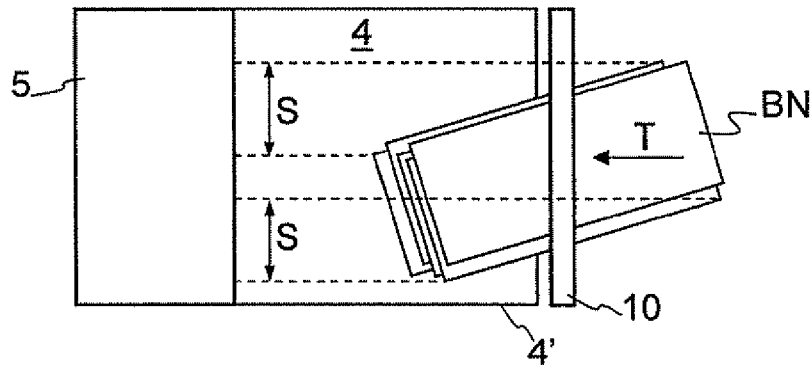
FIG. 3 shows the input of a second stack of sheet material into the apparatus for singling sheet material shown in FIG. 1.

FIG. 3 shows the input of a second stack of bank notes BN into apparatus 1 shown in FIG. 1. In FIG. 3 are shown deposit surface 4 of input area F, singling roller 5, and sensor 10.

The shown second stack of bank notes BN consists of a plurality of bank notes, which are well aligned to each other with respect to their edges. But the whole stack of bank notes BN was obliquely inputted into the input area of the apparatus 1 by the operator. Such off-straight lying bank notes are irregularly grasped by singling roller 5, because of which then they all are transported obliquely with a certain angle by sheet transport system 7 and can cause the problems described above when processed.

Such problems during the processing can be prevented, when such a stack of bank notes BN is recognized and not singled. An evaluation of the signals of linear sensor 10, 11 with the help of control device 12, yields a uniform change of the signals during the transport of the stack of bank notes BN to singler 5, 6, because the stack of bank notes BN, as shown, moves within the dashed lines. During the transport of the stack of bank notes BN to singler 5, 6 in the areas of the linear sensor 10, 11 marked with the reference sign S there change the signals which indicate a presence or absence of bank notes. If during the transport of the stack of bank notes BN in the direction towards singler 5, 6 the number of determined changes of the signals of sensor 10, 11 exceeds a predetermined threshold value, a singling of the bank notes BN forming the stack is not effected. In this case the stack of bank notes is transported out of input area F by stack transport system 2, 3, 3'. Control device 12 can generate an instruction for the operator and display it on display device 13 of apparatus 1. In the described case of the uniform change of the signals of sensor 10, 11, which indicates a stack of bank notes BN inputted obliquely, the operator can be prompted to remove the stack of bank notes BN and to re-input the stack of bank notes BN in a straight fashion into input area F. For this purpose there can be provided, for example, guiding plate 4', which in FIG. 3 forms the end at the bottom edge of input area F or deposit surface 4. Against this guiding plate 4' the bank notes BN can be put when inputted by the operator.

Therefore, conclusions about the stack quality of the stack of bank notes BN can be drawn from the signals of sensor 10, 11 and the singling of stacks of bank notes BN can be prevented, when the bank notes because of poor stack quality can cause problems during the subsequent processing. When during the input of a stack of bank notes BN there occur frequent fluctuations of the signals of certain detectors of sensor 10, 11 between presence and absence of bank notes, this indicates that there are bank notes, which with respect to their edges are not aligned well to each other. When during the input of a stack of bank notes BN there occurs a continuous change of a certain number of signals of detectors located side-by-side of sensor 10, 11, which change from the presence of bank notes to the absence of bank notes, or vice versa, this indicates a stack of bank notes, which has been inputted obliquely into the input area. Dependent on the properties of the singler 5, 6 and of the sheet transport system 7 and other following elements used for further processing bank notes, threshold values for admissible fluctuations and changes of the signals of sensor 10, 11 are determined.

Until now, there has been described the input of a stack of bank notes BN in connection with a stack transport system 2, 3', which transports the stack of bank notes BN to singler 5, 6 after the input by the operator. It is obvious, that sensor 10, 11 can also be used in the above-described fashion, when a stack transport system 2, 3' is not provided, i.e. when the stack of bank notes BN is inputted by the operator into the input area F of the apparatus 1 for the singling up to singler 5, 6.

Further deviations can arise for the structure of apparatus 1 for the singling. For example, deposit surface 4 can reach up to faceplate 8. In this case for sensor 10, 11 there is provided a window or a transparent area in deposit surface 4, when sensor 10, 11 is &mad by a detector 10 with opposite light source 11. Likewise, a faceplate 8 can be omitted, i.e. the input area F cannot be locked. It is also possible to transport the sheet material along its short edges and not, as shown, along its long edges. Likewise, it is possible, that the longitudinal extent of sensor 10, 11 instead of to the width of input area F corresponds to the width of deposit surface 4, the width of singler 5, 6, or the width of transport system 7.

The described apparatus 1 for singling sheet material is suitable in particular for bank notes, which are provided in stacks and have to be singled for a processing. For example for the purpose of automatically accepting or depositing bank notes or their automatic checking or sorting etc.

The invention claimed is:

1. Apparatus for singling sheet material, comprising:

an input area having a width and configured to receive stacks of sheet material to be singled;

a singler arranged to single sheet material received in the input area;

a stack transport arrangement upstream of the singler enabling transport of stacks of sheet material from the input area to the singler in a stack transport direction;

a sheet transport system;

said singler arranged to feed singled sheets of sheet material to the sheet transport system;

said sheet transport system arranged to receive singled sheets of sheet material from the singler and to transport them from the singler in a sheet transport direction;

a sensor disposed upstream of the singler relative to the stack transport direction, said sensor arranged to sense an area extending over the width of the input area, and to generate signals which specify whether and in which area of the width of the input area the sheet material is present, and a control device, arranged to receive and evaluate the signals of the sensor during a transport of the stack of sheet material to the singler and to compare fluctuations and changes of the signals of the sensor regarding the presence or absence of sheet material with predetermined threshold values for fluctuations and changes of the signals of the sensor, and to derive information from the fluctuations and changes of the signals of the sensor as to whether the sheets forming the stack of sheet material are aligned with each other with respect to their edges, and whether the stack of sheet material has an alignment which substantially is parallel to the sheet transport direction;

wherein the control device is arranged to control the singler so as to prevent the singling of the stack of sheet material when an evaluation of the signals of the sensor indicates that the sheets of sheet material forming the stack of sheet material are poorly aligned with each other with respect to their edges or the stack of sheet material has an alignment which deviates from the sheet transport direction.

2. The apparatus according to claim 1, said sensor comprising a plurality of light barriers distributed over the width of the input area.

3. The apparatus according to claim 1, wherein the sensor comprises a line camera.

4. The apparatus according to claim 1, said stack transport arrangement comprising a stack transport system associated with the input area, said stack transport system configured to transport stacks of sheet material to the input area.

5. The apparatus according to claim 1, wherein the control device and the stack transport system are arranged so as to enable transport of a stack of bank notes out of the input area.

6. The apparatus according to claim 1 wherein the control device is arranged to generate instructions for an operator and to display the instructions on a display device, said instructions related to a need to remove the stack of sheet material from the input area and to re-input it with an improved alignment of the sheet material and/or of the stack of sheet material.

* * * * *